US007417364B2

(12) United States Patent
Wegman et al.

(10) Patent No.: US 7,417,364 B2
(45) Date of Patent: Aug. 26, 2008

(54) LIGHT SOURCE WITH SEALANT COVER

(75) Inventors: Joseph L. Wegman, Henniker, NH (US); John Hoover, Canterbury, NH (US); James Greason, Warner, NH (US)

(73) Assignee: Osram Sylvania, Inc., Danvers, MA (US)

( * ) Notice: Subject to any disclaimer, the term of this patent is extended or adjusted under 35 U.S.C. 154(b) by 243 days.

(21) Appl. No.: 11/519,173

(22) Filed: Sep. 11, 2006

(65) Prior Publication Data

US 2008/0061671 A1 Mar. 13, 2008

(51) Int. Cl.

| | |
|---|---|
| ***H01J 5/48*** | (2006.01) |
| ***H01J 5/50*** | (2006.01) |
| ***H01J 17/18*** | (2006.01) |
| ***H01J 61/36*** | (2006.01) |
| ***H01J 17/16*** | (2006.01) |
| ***H01J 61/30*** | (2006.01) |

(52) U.S. Cl. ..... 313/318.01; 313/623; 313/624; 313/625; 313/634

(58) Field of Classification Search ..... 313/569, 313/578, 579, 623–626, 634, 312, 315, 317, 313/318.01, 318.08, 318.09

See application file for complete search history.

(56) References Cited

U.S. PATENT DOCUMENTS

| | | | | |
|---|---|---|---|---|
| 3,859,554 | A * | 1/1975 | Preziosi et al. | 313/315 |
| 5,463,270 | A * | 10/1995 | Wakimizu et al. | 313/318.01 |
| 5,696,424 | A * | 12/1997 | Coushaine | 313/318.1 |
| 6,080,019 | A * | 6/2000 | Coushaine | 439/611 |
| 6,270,235 | B1 * | 8/2001 | Coushaine | 362/645 |

* cited by examiner

*Primary Examiner*—Karabi Guharay
*Assistant Examiner*—Bumsuk Won
(74) *Attorney, Agent, or Firm*—William E. Meyer

(57) ABSTRACT

A light source includes a lamp and housing. The housing has a right-angle form with a first leg for the lamp, a second leg for connecting leads for the lamp and a jointure between the legs having an aperture allowing access to the connecting leads and lead-ins. The aperture has a bottom containing openings for the lamp leads-in and a contiguous sidewall containing openings for the connecting leads. The lead-ins and connecting leads are attached in the aperture to form lugs. A cover for closing the aperture has an area matching the area of the aperture and has outer and inner surfaces. The inner surface has a central boss and depending flanges that, when fitted into the aperture after a sealant has been dispensed therein, the boss extends between the lugs and the flanges extend outside the lugs, serving to displace the sealant and force it to surround the lugs.

3 Claims, 2 Drawing Sheets

LIGHT SOURCE WITH SEALANT COVER

TECHNICAL FIELD

This invention relates to light sources and more particularly to vehicle headlamps. Still more particularly, it relates to a cover for an environmental seal used with the headlamp.

BACKGROUND ART

Many automotive vehicles employ headlamps that use tungsten-halogen light bulbs. These light bulbs are often fitted to a right-angled socket that includes means for receiving a connector. The socket includes an aperture at the angled portion that allows access to the bulb lead-ins and the connector contacts so that they can be welded or otherwise attached together to form lugs so that electrical connection can be made from the connector to the bulb.

In the past it has been the practice to dispense a viscous sealant material into the aperture after the welds have been made to seal the lugs from the environment. A substantially flat cover was then applied to the aperture for aesthetic purposes. In spite of these efforts it has been found on occasion that corrosion can affect the lugs and interfere with the lamp performance. It has been determined that the problem is caused by the difficulty in controlling the amount and location of the sealant.

DISCLOSURE OF THE INVENTION

It is, therefore, an object of the invention to obviate the disadvantages of the prior art.

It is another object of the invention to enhance vehicle headlamps.

These objects are accomplished, in one aspect of the invention, by the provision of a light source that includes a lamp and a housing, the housing having a first leg formed to receive the lamp, a second leg formed to receive connecting leads for the lamp and a jointure between the first and second legs having an aperture for allowing access to the connecting leads and lead-ins formed with the lamp, the aperture having a bottom containing openings for receiving the lamp leads-in and a contiguous sidewall containing openings for receiving the connecting leads, the lead-ins and the connecting leads being attached together within the aperture to form lugs. A cover closes the aperture and comprises a lid having an area matching the area of the aperture and having an outer surface and inner surface, the inner surface having a central boss fitted between the lugs and depending flanges fitted outside the lugs.

This cover arrangement protects the lugs from corrosion. In a preferred embodiment of the invention, a viscous sealant is dispersed into the aperture before the cover is applied and the central boss and the flanges serve to distribute the sealant about the lugs. Further, employing the central boss and the depending flanges cuts the amount of sealant necessary to be dispensed in half.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
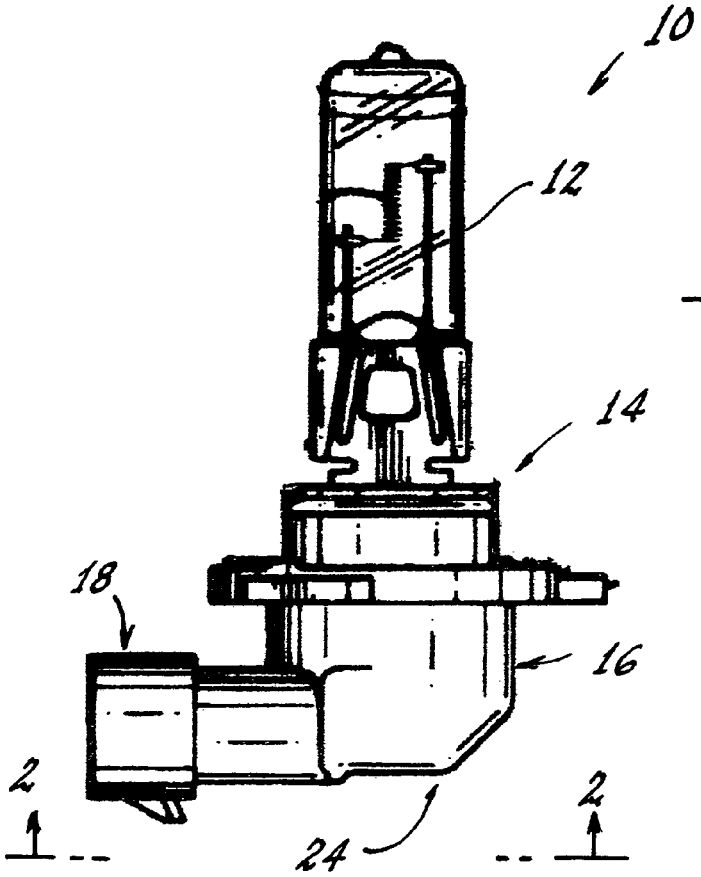
FIG. 1 is an elevational view of light source according to an aspect of the invention.
Figure 2:
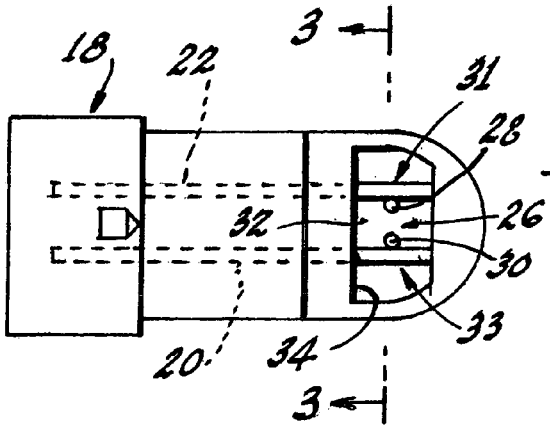
FIG. 2 is a plan view taken along the line 2-2 of FIG. 1.
Figure 3:
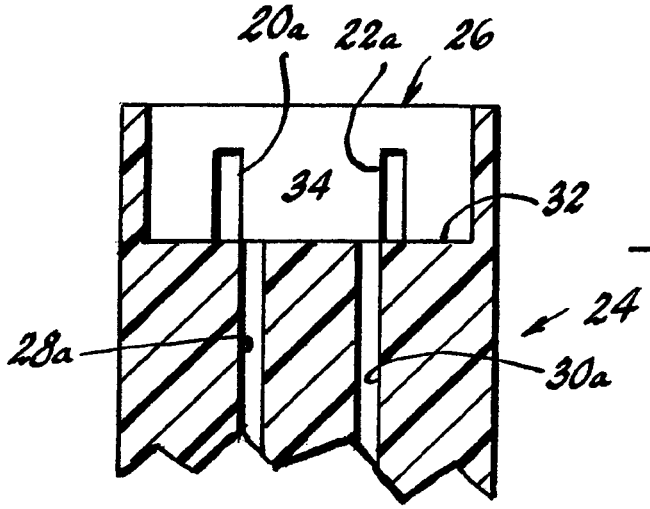
FIG. 3 is a partial, sectional view taken along the line 3-3 of FIG. 1 with all electrical elements removed.

Referring now to the invention with greater particularity, there is shown in FIG. 1 a light source 10 including a lamp 12 and a housing 14. The housing 14 takes the form of a right angle having a first leg 16 formed to receive the lamp, a second leg 18 formed to receive connecting leads 20, 22 for the lamp and a jointure 24 between the first and second legs having an aperture 26 for allowing access to the connecting leads 20, 22 and lead-ins 28, 30 formed with the lamp 12. The aperture 26 is seen most clearly in FIGS. 2-5 and has a bottom 32 containing openings 28*a*, 30*a* for receiving the lamp leads-in and a contiguous sidewall 34 containing openings 20*a*, 22*a* for receiving the connecting leads. These openings are shown in FIG. 3. The lead-ins 28, 30 and the connecting leads 20, 22 are attached together, preferably by welding, within the aperture to form lugs 31, 33.

Figure 4:
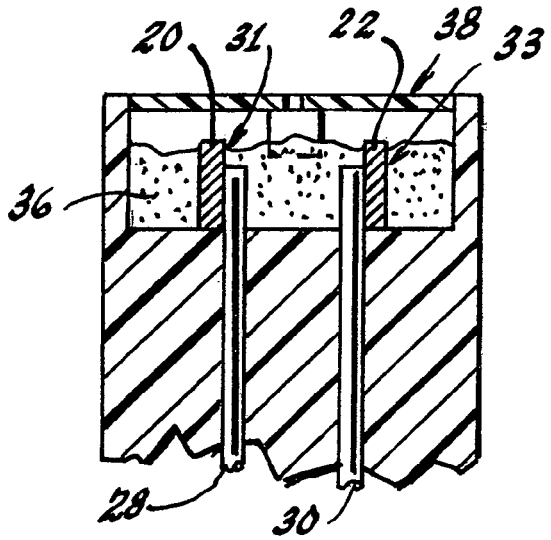
Fig. 4 PRIOR ART
FIG. 4 is a similar view of a prior art light source with the previous cover.

FIG. 4 details the prior art structure wherein a substantially flat cover 38 closed the aperture 26 after a sealant 36 was dispensed into the aperture. As can be seen from FIG. 4, there was no guarantee that the sealant, while covering the openings in the bottom of the aperture, would completely cover the lugs to provide an environment seal.

Figure 5:
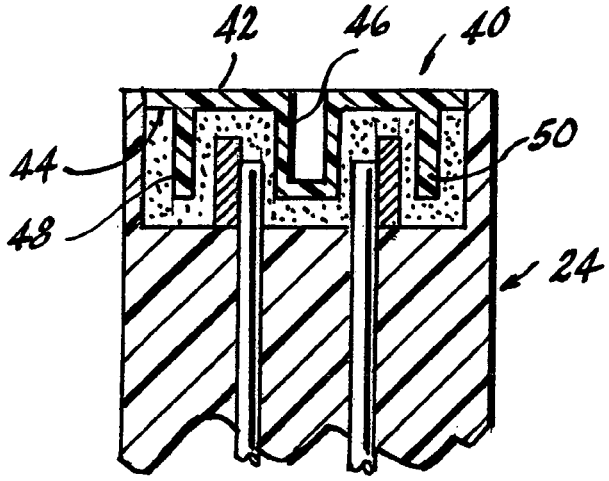
FIG. 5 is a similar view of an embodiment of the invention.

Referring now to FIG. 5, it will be seen that these problems are solved by a cover 40 that closes the aperture 26. The cover 40 has an area that matches the area of the aperture 26 and has an outer surface 42 and inner surface 44. The inner surface 44 has a central boss 46 and depending flanges 48, 50 such that, when the cover 40 is fitted into the aperture 26 after a sealant 36 has been dispensed therein, the central boss 46 extends between the lugs 31, 33 and the depending flanges 48, 50 fitted outside the lugs, these elements serving to displace the sealant and force it to surround the lugs 31, 33. Because the central boss 46 and the flanges 48 and 50 have a given volume, the mount of sealant necessary to insure coverage of the lugs is greatly reduced.

The seals old and new, have been tested using a salt fog spray under extreme conditions, i.e., using an additional sprayer directly on the cover region. Under this condition the prior art cover design resulted in some corrosion being present whereas the cover with the central boss and depending flanges have distinct positive results in corrosion reduction.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. In a light source including a lamp and a housing, said housing having a first leg formed to receive said lamp, a second leg formed to receive connecting leads for said lamp and a jointure between said first and second legs having an aperture for allowing access to said connecting leads, and lead-ins formed with said lamp, said aperture having a bottom containing openings for receiving said lamp leads-in and a contiguous sidewall containing openings for receiving said connecting leads, said lead-ins and said connecting leads being attached together within said aperture to form lugs; the improvement comprising:

a cover closing said aperture, said cover having:

an area matching the area of said aperture and having an outer surface and inner surface, said inner surface having a central boss fitted between said lugs and depending flanges fitted outside said lugs.

2. The light source of claim 1 wherein a viscous sealant is provided within said aperture.

3. The light source of claim 2 wherein said central boss and depending flanges displace said sealant to completely cover said lugs.

* * * * *